United States Patent [19]

Seydelmann

[11] 4,072,277

[45] Feb. 7, 1978

[54] CUTTER BLADE FOR FOOD PROCESSING

[76] Inventor: Ludwig Seydelmann, Holderlinstrasse 9, 7 Stuttgart 1, Germany

[21] Appl. No.: 735,007

[22] Filed: Oct. 22, 1976

[30] Foreign Application Priority Data

Nov. 25, 1975 Germany ..... 2552723

[51] Int. Cl.[2] ..... B02C 18/20

[52] U.S. Cl. ..... 241/292.1; 83/665; 241/199.7

[58] Field of Search ..... 241/199.5, 199.6, 199.7, 241/282.1, 282.2, 292.1; 83/596, 665; 30/347

[56] References Cited

U.S. PATENT DOCUMENTS

| | | | |
|---|---|---|---|
| 2,934,120 | 4/1960 | Schnell | 241/292.1 |
| 2,970,621 | 2/1962 | Bohm | 241/199.7 X |
| 3,764,081 | 10/1973 | Seydelmann | 241/199.7 |

FOREIGN PATENT DOCUMENTS

| | | | |
|---|---|---|---|
| 173,993 | 2/1953 | Austria | 241/199.7 |
| 206,322 | 11/1959 | Austria | 241/292.1 |

*Primary Examiner*—Joseph H. McGlynn
*Assistant Examiner*—Howard N. Goldberg
*Attorney, Agent, or Firm*—Karl F. Ross

[57] ABSTRACT

A cutter blade for a food processor or chopper has a scimitar-shaped body with a convex cutting edge leading in the direction of rotation about an axis perpendicular to its major faces, one of these faces being stepped to form one or more ancillary edges inwardly of the cutting edge and in different planes of rotation. The several ancillary edges may be separated from one another by surface depressions and preferably lie at an acute angle to the direction of rotation.

8 Claims, 6 Drawing Figures

CUTTER BLADE FOR FOOD PROCESSING

FIELD OF THE INVENTION

My present invention relates to a cutter blade for the chopping of foodstuffs or the like in a processor or chopper in which such a blade is mounted on a shaft rotating at high speed.

BACKGROUND OF THE INVENTION

A cutter blade of this description, e.g. as shown in my prior U.S. Pat. No. 3,764,081, has a generally flat body whose two major surfaces are substantially transverse to the axis of rotation and meet in a sharp cutting edge which occupies a leading position as seen in the direction of rotation. Such a blade may have a variety of outlines, with either straight or curved leading and trailing edges. The blade usually has a more or less pointed tip which sweeps along the inner surface of an annular bowl.

As the fulcrum of the rotating blade advances along the centerline of the toroidal bowl surface, the goods to be chopped (referred to hereinafter as foodstuffs) exert pressure upon one of its major surfaces and also upon a marginal zone of the other surface adjacent the cutting edge, this zone being either flat or convex as its thickness increases from zero at the edge to a maximum at a certain distance from that edge. This marginal zone exerts both a chopping and a whipping effect upon the foodstuffs in order to emulsify them. Those effects increase with the blade velocity, as does the generated heat and the power consumption. Moreover, conventional blades have a tendency to entrain a considerable amount of air radially outwardly with the comminuted foodstuffs; the presence of this air in the chopped goods, e.g. sausage meat, has a tendency to induce oxidation and objectionable discoloration.

It has already been proposed to form the working surface of the blade with a multiplicity of generally radial grooves, terminating short of the cutting edge; see German Pat. No. 1,632,111 and utility model No. 1,718,070. The ridges between these grooves, lying in a common plane or rotation transverse to the axis, do not act cumulatively upon the encountered foodstuffs but are merely designed to improve air circulation.

OBJECT OF THE INVENTION

The object of my present invention, therefore, is to provide an improved cutter blade which is more efficient in operation, avoids objectionable air occlusions and has great mechanical strength.

SUMMARY OF THE INVENTION

In accordance with my present invention, one of the major surfaces of the generally flat blade body — i.e. the surface opposite the one confronting the oncoming foodstuffs — is stepped to form one or more ancillary edges inwardly of the cutting edge, each ancillary edge facing in the direction of rotation. Successive ancillary edges lie at progressively greater distances from the plane or rotation of the cutting edge so as to have non-coincident planes of rotation of their own whereby each of these ancillary edges cuts through a different section of the mass of foodstuffs.

Advantageously, the stepped blade surface is depressed between the ancillary edges so as to increase the effective height of the steps whose transverse lands or risers exert the aforementioned whipping effect.

BRIEF DESCRIPTION OF THE DRAWING

The above and other features of my invention will now be described in detail with reference to the accompanying drawing in which.

SPECIFIC DESCRIPTION

Figure 1:
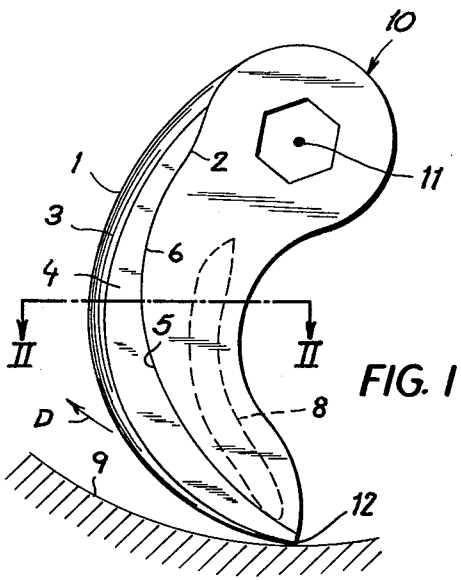
FIG. 1 is an elevational view of a cutter blade according to my invention, showing part of a bowl swept by the tip of the rotating blade.

In FIG. 1 I have shown a sickle-shaped blade 10 with a fulcrum 11 about which it rotates at high speed in the clockwise direction, as indicated by an arrow D, upon being mounted on a shaft of noncircular (here hexagonal) cross-section. A pointed tip 12 of the blade, remote from its fulcrum, sweeps the inner surface of a bowl 9 which may have an annular or toroidal shape similar to that shown in my aforementioned prior U.S. Pat. No. 3,764,081. The convex leading flank of the blade forms a continuous cutting edge 1 adjoining a marginal zone 3 which is beveled to form a facet and merges into a plateau 4 terminating at a step 5. This step forms an ancillary edge 6 which generally parallels the cutting edge 1 but lies at a different level; in the vicinity of fulcrum 11 the step 5 becomes shallower along a transition edge 2 eventually meeting an extension of cutting edge 1. The latter edge has a plane of rotation P (FIG. 5) which coincides with the opposite blade surface and substantially prallels the plateau 4.

Figure 2:
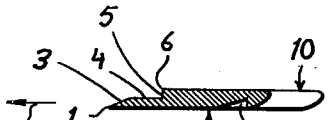
FIG. 2 is a cross-sectional view taken along the line II — II of FIG. 1.
Figure 3:
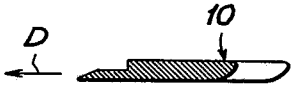
FIG. 3 is a view similar to FIG. 2, illustrating a modification.

In order to relieve the pressure along the surface encountering the stream of goods to be processed, as indicated by an arrow E in FIG. 2, I prefer to provide the latter surface with an elongated recess 8 offset over most of its length from the ancillary edge 6 in a direction away from cutting edge 1. As shown in FIG. 3, however, that recess could also be omitted.

Figure 4:
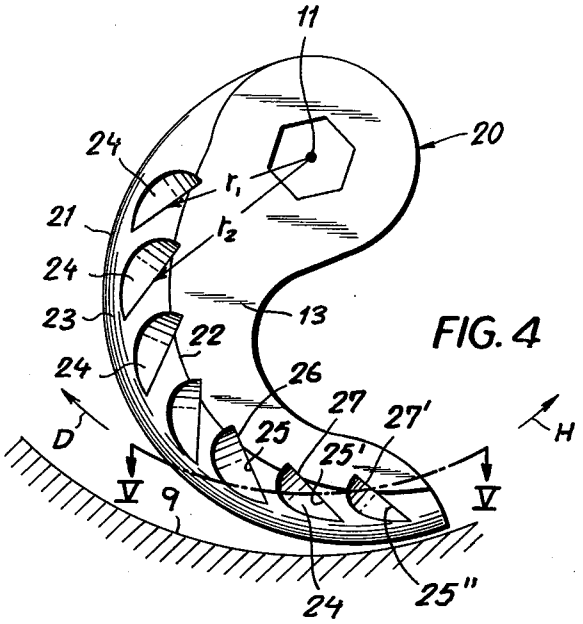
FIG. 4 is an elevational view similar to FIG. 1, showing a modified blade according to my invention.
Figure 5:
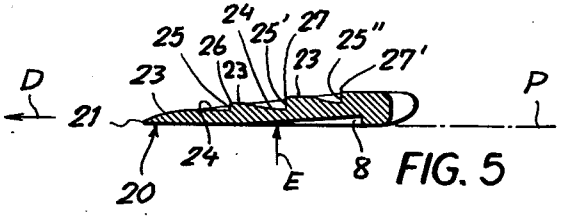
FIG. 5 is a cross-sectional view taken along the curve V — V of FIG. 4.

In FIGS. 4 and 5 I have shown a more strongly curved, generally scimitar-shaped blade 20 with a convex cutting edge 21 and a marginal zone 23 separated by a transition edge or crease line 22 from a flat surface portion 13 adjoining the trailing edge of the blade. Zone 23 carries a multiplicity of steps preceded by flattened lands 24 each substantially parallel to the plane of rotation of edge 21, successive steps 25, 25', 25'' (FIG. 5) forming ancillary edges 26, 27, 27' which are axially offset from one another to cut into the surrounding mass at different levels. Thus, edge 27' at the end of the curved array remote from fulcrum 11 has the greatest axial distance from the plane of rotation P of cutting edge 21. The foodstuff being comminuted travels along these ancillary edges, as indicated by an arrow H, so as to be effectively emulsified in a series of stages.

All the ancillary edges 26, 27, 27' include acute angles with the cutting edge 21 and also with radii $r_1$, $r_2$, etc. extending from fulcrum 11 to the midpoints of these edges, the latter angles increasing progressively from the first to the last edge of the array. This angular orientation insures more effective cutting and avoids sharp discontinuities which could overstress the blade.

Figure 6:
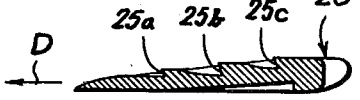
FIG. 6 is another cross-sectional view, illustrating a further modification.

As illustrated in FIG. 6, risers 25*a*, 25*b*, 25*c* of the peripherally and axially staggered steps could be undercut so that the ancillary edges formed thereby have acute-angled cross-sections rather than orthogonal ones as in the preceding FIGURES. Since these edges work with a slanting cut, no foodstuffs tend to accumulate in the undercuts.

I have found, rather surprisingly, that the highly effective centrifugal action of my improved blade densifies the chopped goods at locations remote from the fulcrum 11 so that the air is squeezed out and escapes inwardly, yielding a rather homogeneous product less likely to oxidize than chopped foods produced by processors using conventional blades.

I claim:

1. A blade for chopping foodstuffs and the like when set in rotation about an axis, comprising a generally flat body with two major surfaces substantially transverse to said axis meeting in a continuous cutting edge leading in the direction of rotation, one of said major surfaces having a marginal zone bounded by said cutting edge, said marginal zone sloping away from the plane of rotation of said cutting edge and merging into at least one flattened land substantially paralleling said plane of rotation, said flattened land terminating at a step rising from said land and forming an ancillary edge inwardly of said cutting edge facing in said direction of rotation.

2. A blade as defined in claim 1 wherein said marginal zone merges into several flattened lands terminating at steps forming respective ancillary edges at progressively greater axial distances from the plane of rotation of said cutting edge.

3. A blade as defined in claim 2 wherein said body is generally scimitar-shaped with said cutting edge lying on a convex side thereof, said body having a concave side separated from said ancillary edges by a substantially planar surface portion.

4. A blade as defined in claim 3 wherein said body has a sharp point and a fulcrum remote from said point, said ancillary edges lying in a curvilinear array generally paralleling said cutting edge between said fulcrum and said point.

5. A blade as defined in claim 4 wherein said ancillary edges include progressively larger acute angles, starting at the end of the array next to said fulcrum, with respective radii originating at said fulcrum and ending midway at the respective edges.

6. A blade as defined in claim 1 wherein said cutting edge is convex and the other of said major surfaces is provided with an elongate recess generally paralleling a portion of said cutting edge.

7. A blade as defined in claim 6 wherein at least the major part of said recess is offset from said ancillary edge in a direction away from said cutting edge.

8. A blade as defined in claim 1 wherein said step is undercut at said ancillary edge and has an acute-angled cross-section.

* * * * *